US006236319B1

(12) United States Patent
Pitzer et al.

(10) Patent No.: US 6,236,319 B1
(45) Date of Patent: May 22, 2001

(54) PERSONAL MONITORING SYSTEM

(76) Inventors: Beryl E. Pitzer, 16745 Camellia Ct., Fraser, MI (US) 48026; John O. Ghazarian, 308 Gondola Way, Henderson, NV (US) 89014

( * ) Notice: Subject to any disclaimer, the term of this patent is extended or adjusted under 35 U.S.C. 154(b) by 0 days.

(21) Appl. No.: 09/364,940

(22) Filed: Jul. 30, 1999

Related U.S. Application Data

(60) Provisional application No. 60/094,899, filed on Jul. 31, 1998.

(51) Int. Cl.[7] ..... G08B 23/00

(52) U.S. Cl. ..... 340/573.4; 340/572.8; 340/572.9; 340/573.4

(58) Field of Search ..... 340/573.4, 573.3, 340/572.9, 572.8

(56) References Cited

U.S. PATENT DOCUMENTS 4,980,671 * 12/1990 McCurdy ..... 340/568
5,014,040 * 5/1991 Veaver et al. ..... 340/572
5,032,823 * 7/1991 Bower et al. ..... 340/568
5,115,223 * 5/1992 Moody ..... 340/573
5,204,670 * 4/1993 Stinton ..... 340/825.54
5,525,969 * 6/1996 Ladue ..... 340/573
5,612,675 * 3/1997 Jennings et al. ..... 340/573
5,627,520 * 5/1997 Grubbs et al. ..... 340/572
5,731,757 * 3/1998 Layson, Jr. ..... 340/573
5,936,529 * 8/1999 Reisman et al. ..... 340/573.1

* cited by examiner

*Primary Examiner*—Jeffery Hofsass
*Assistant Examiner*—Son Tang
(74) *Attorney, Agent, or Firm*—John R. Benefiel

(57) ABSTRACT

A body worn transmitter periodically transmits a coded rf signal from a rolling code generator, which is received by a base unit at the location where a person is confined, which base unit has a rolling code generator synchronized to produce the same random code signal for comparison. If proper coded signals are not received, a report is sent via telephone to a remote monitoring station. The body worn transmitter is designed to detect and defeat attempts at removal. The body worn transmitter is also used to detect the presence of a person at a particular location. By programming the time of rf transmissions, a large number of body worn transmitters can be monitored at a given location.

6 Claims, 7 Drawing Sheets

PERSONAL MONITORING SYSTEM

CROSS REFERENCE TO RELATED APPLICATION

This application claims the benefit of provisional Ser. No. 60/094,899, filed Jul. 31, 1998.

BACKGROUND OF THE INVENTION

The present invention concerns personal monitoring devices and more particularly such device utilizing a body worn transmitter which transmits an rf signal to a base unit at periodic intervals such that the presence of a person wearing the monitor within a predetermined range of the base unit can be verified. Such devices have come into relatively widespread use particularly in the context of the "tethering" of persons sentenced to home confinement. Such systems and devices have also been employed to monitor the presence of a person wearing a transmitter in an area which is forbidden to that person, to give warning or to enable notification of the authorities.

A recurrent problem with such devices is the possibility of the wearer substituting another transmitter by use of "code grabbing" equipment in which the code signal transmitted to the base unit is identified and such coded signal can then be reproduced with another transmitter device, allowing the tethered person to leave the premises without his or absence being detected by the base unit.

Another difficulty concerns the possibility that the tethered person will cut off the body worn device, typically held by a band which encircles the arm or leg of the tethered person. It is a simple matter to detect such severing of the band by causing this to interrupt the power supply circuit for the transmitter.

However, a variety of avoidance techniques have been devised, such as placing the band in salt water prior to severing, so that the circuit will not be broken when the band is severed since salt water is a relatively good electrical conductor.

Another drawback is that such systems are costly to administer for various reasons. The complexity and the cost of the equipment heretofore provided has been high. The fitting of large numbers of transmitters has also been a time consuming and expensive task for the enforcement authorities.

It is an object of the present invention to provide a body worn transmitter device which is relatively low in cost, yet reliable and resistant to attempts to defeat the system.

SUMMARY OF THE INVENTION

The present invention includes a transmitter adapted to be body worn by the monitored individual, having an encircling band custom fit to the limb of the individual involved by a quick and convenient procedure, and which is difficult to remove without detection.

The system comprises the body worn transmitter, a local base unit at a confinement location remote from a monitoring station, the monitoring station in communication with the base unit by a phone system (which could be conventional, cellular, etc.). The body worn transmitter sends a coded signal at short (variably set) intervals, i.e., one to five minutes, which are received by the base unit if within a variably set range from the base unit. The coded signal is changed with every transmission cycle to prevent code grabbing (i.e., a rolling code change). A crystal synchronized stored code selection is carried out in both the body worn transmitter and in the base unit (these are commercially available microprocessor-crystal devices suited to this purpose). Software synchronizes the body worn transmitter and base unit code generators at set up so that the same signal is generated by each.

If the properly coded body worn transmitter signal is not received at the prescribed times, the base unit may optionally be equipped with a transmitter having the ability to send a stronger signal to the out of range body worn transmitter or to a separate pager-alarm to trigger a vibration or other alarm on the body worn transmitter or the separate pager-alarm carried by the person, to warn that the wearer is out of range, allowing the person a chance to return to the confined location before the base unit reports a violation to the remote monitoring station.

If a properly coded signal is still not received after some additional brief time, the base unit sends a phone data report to the remote monitoring station, which alerts appropriate personnel of the situation.

The body worn transmitter is held with a limb encircling flexible strap or band which has an internal conductor forming part of a circuit which operates the battery powered transmitter. An activation key may be required to apply a coded start up signal when the strap is connected. The ohm resistance of the conductor at start up is detected and recorded in a microprocessor in the body worn transmitter, (after the band is cut to the correct size). If the band is cut, the transmitted signal stops. If immersion in a bucket of salt water is attempted to maintain an electrical connection, the difference in ohm resistance value will be detected, and prevent the coded signal will still not be transmitted.

The activation key is needed to be applied prior to reconnection if the band is disconnected.

The clock circuit which causes the periodic rf transmissions can alternatively be used which is shut off permanently whenever there is an interruption of a circuit of which the band forms a part.

A doubled antenna is embedded in the band and used to allow a variable range to be set by a change of program in the base unit microprocessor.

A hand held unit with stored code information for monitoring a number of people allows drive by checking of tethered individuals probationers, etc. This unit may have a signal strength indicator as a locator aid.

An alternative arrangement may be employed where a sophisticated band cut off feature is not deemed necessary, in which case a simplified software programming can simply prevent restarting of the transmitter upon any circuit interruption no matter how brief, in the circuit of which the conductor in the band forms apart.

In this case, a coded start up signal is required and will be employed when conducting the initial band fitting and when making any subsequent adjustments necessitating interruption of the transmitter circuit. A delay period may be programmed, allowing circuit interruptions for a brief time, i.e., 10 minutes, so that the fitting process may be completed.

The body worn transmitter, in addition to the rolling coded signal, also transmits an identifier signal to the base unit unique to that particular transmitter, and the base unit is preferably capable of a learning mode with a brief push button operation of the transmitter initially enabling the base unit to learn the identifier code of the particular transmitter being fit.

The coded start up signal can also be optionally applied by means of a transceiver installed in the body worn transmitter, in which the unique start up coded signal is transmitted to the body worn device, initiating the cyclical rf transmissions.

The body worn transmitter can also be employed as a monitor for detection of the presence of a person wearing the transmitter at some particular location forbidden to that person by a protective court order, using a receiver base unit at the forbidden location which will sound an alarm upon receiving a transmitted signal with the specific identifier signal unique to the transmitter worn by the person under court order.

The base unit in this instance can cause one or several prerecorded messages to be communicated via a modem and the phone system to various authorities. In addition, an alarm can be incorporated to sound or otherwise make a person or persons at the protected location aware of the presence of the person wearing the body worn transmitter. In this instance, transmission of a changing, i.e., rolling coded signal is not necessary, merely the unique identifier signal associated with the particular transmitter.

Also, the hand held unit can be employed by probation officers, etc., to monitor these locations to determine if the person is, in fact present at such locations. The hand held unit in this case can be provided with a number of stored identifier signals such that a number of several individuals may be monitored.

The system can also be used to monitor large numbers of people at a site (or items of equipment, livestock, inventory, etc.). In this case, a scanner is used to program a specific time slot to each body worn transmitter so that only one transmitter at a time sends a signal to the base unit.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1B:
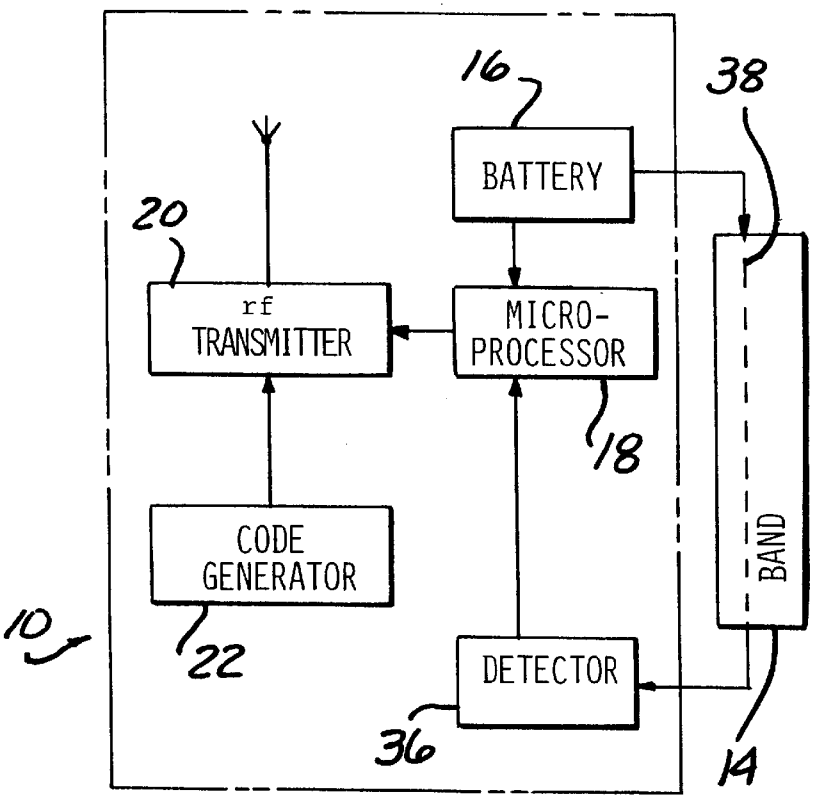
FIG. 1B is a block diagram representation of a body worn transmitter according to the first embodiment of the present invention.
Figure 1A:
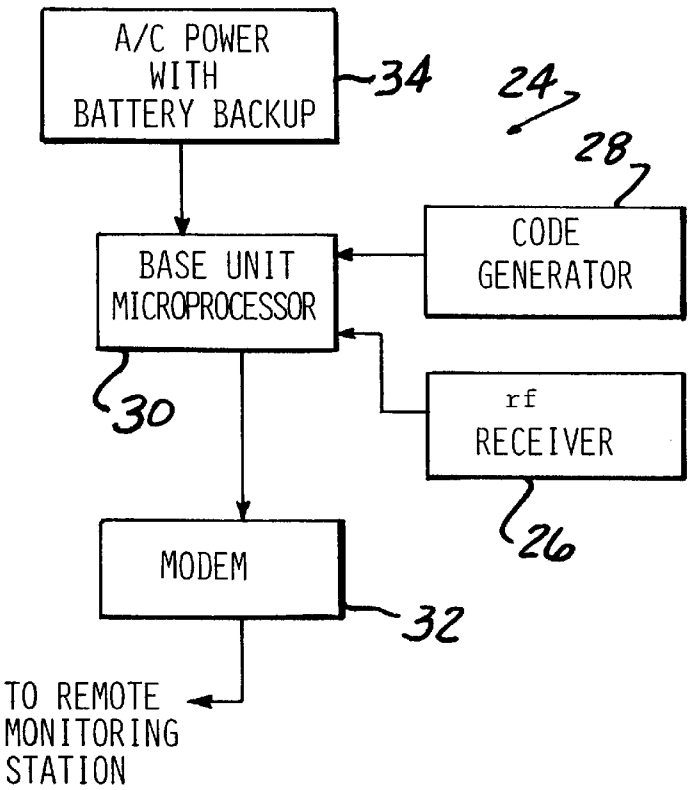
FIG. 1A is a block diagram of the base unit components according to a first embodiment of the invention.

Referring to FIGS. 1A and 1B, the present invention includes a body worn transmitter 10 enclosed in a case 12 depicted diagrammatically in phantom lines case, held on the wearer by a flexible band 14 adapted to be connected at either end to the casing 12 and sized to encircle a body member, typically the wrist of the person to be monitored.

Case 12 holds a battery 16 suitable for long term use, i.e., a 3 volt lithium battery will provide a battery life of 12 months. The battery 16 powers a microprocessor 18 which is suitably programmed with software to provide the control over transmissions by an rf transmitter 20 according to the present invention.

The transmitter 20 regularly broadcasts coded rf signals at periodic intervals, the length of the interrupt set by the software program and microprocessor 18, i.e., one, two, three or four minutes. The transmitted coded signals includes a unique identifier signal assigned to the particular body worn transmitter 10 at manufacture as well as a rolling coded signal, generated by a code generator 22. Such code generators are crystal synchronized and commercially available, suitable such device being the MPS 500. The coded signal randomly selects one of 10 trillion code signals to be transmitted. This signal changes with every successive signal transmission in order to make it impossible for code grabbing equipment to enable broadcast of an imitated signal from another transmitter.

The signal transmitted by the rf transmitter 20 is received by a local base unit 24 which includes an rf receiver 28. A second synchronized code generator 26 identical to the code generator 22 produces the identical random regenerated signal transmitted to a base unit microprocessor 30 which has been suitably programmed to provide the control functions described. For each transmission of the transmitter 20 of a coded signal produced by the code generator 22, the same coded signal is generated by code generator 28, and is transmitted to the microprocessor 30 for comparison with the signal received from the rf transmitter 20. Synchronization is insured by an initial set up in which the code generators 22 are simultaneously initiated by microprocessor 30.

The microprocessor 30 is also programmed at set up with the identifier coded signal for the particular body worn transmitter 10. If the proper signal is received at the scheduled time interval by receiver 28, as determined by the microprocessor 30, nothing further happens. However, if there is an absence of the signal for a predetermined maximum period, the microprocessor 30 causes communication of a notification signal to a remote monitoring station via a telephone modem 32, advising the authorities of the absence of the wearer from the confinement location.

An ac power supply with a battery back up 34 is provided for the base unit 24. The program of the microprocessor 30 provides for reporting of information of various operating information, i.e., if there is a power failure or telephone service interrupted. The base unit 24 continues to record any absence of the transmitted coded signal. When telephone service is restored the microprocessor 30 cause a report of the intervening activity to be transmitted.

A low battery condition of the body worn transmitter 10 also results in a signal being transmitted to the base unit 24 which is also recorded by the microprocessor 30, and reported via modem 32.

A low battery condition of the base unit 24 also results in a report generated by the microprocessor 30 transmitted by the modem 32 to the remote monitoring station.

The microprocessor 30 of the base unit 24 is also programmed to exercise priority control over the telephone line to which the modem 32 is connected, i.e., if the line is being used, the processor 30 causes disconnection of the existing connection in order to report signals to the remote monitoring station.

It should be understood that the software required to perform these described functions may be provided by conventional software programming techniques. A suitable software program has been produced by Climax Technologies of Taiwan, ROC.

The microprocessors 18, 30 suitable for such application are commercially available such as PIC-16-54 and PIC 16-7-57R.

A resistance detector 36 is also included in one embodiment of the body worn transmitter 10. Detector 36 detects the ohm resistance of a conductive wire 38 embedded in the band 14. Upon detection of any interruption of the circuitry caused by cutting the conductor 38, the transmitter is shut off.

Any attempt at restarting after reconnection such as by a jumper connector will be ineffective to restart the transmitter which is blocked by the software programming. A coded restart signal will then be required.

According to one embodiment, the detector 36 includes means for measuring the resistance at start up of the circuit loop including the conductor 38 of the band 14. Any attempt to bypass the band 14 and/or element 38 as by salt water immersion will inevitably result in a slight difference in resistance. This difference is detected by the detector 36 and the software of the microprocessor 18 will prevent any further transmission by the rf transmitter 20, and also generate a special signal transmitted which when received by the base unit receiver 26 causes the microprocessor 30 to generate a special report transmitted via modem 32 to the remote monitoring station indicating that the band 14 has been tampered with, such that suitable action can be taken by the authorities.

Figure 2B:
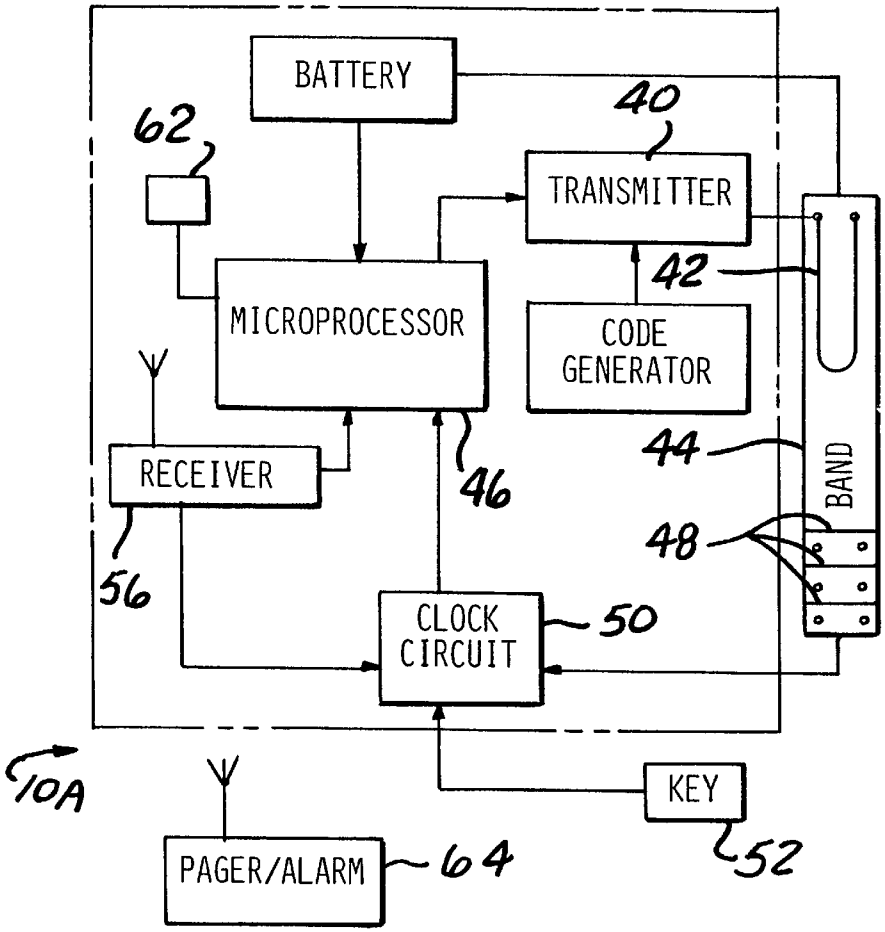
FIG. 2B is a block diagram representation of the body worn transmitter components according to the second embodiment of the invention along with a portable separate pager alarm unit.
Figure 2A:
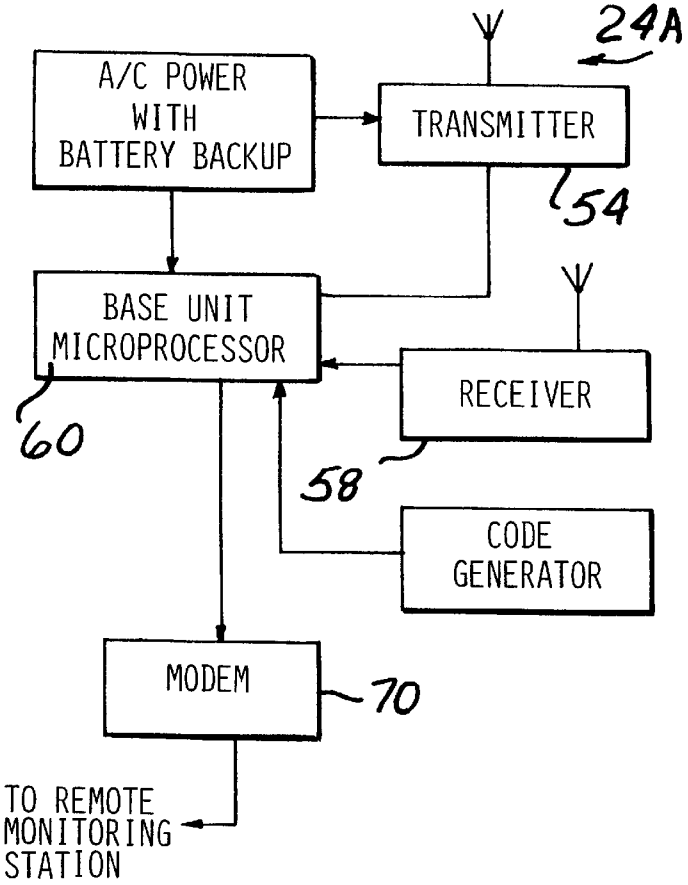
FIG. 2A is a block diagram of the base unit components according to another embodiment of the invention.

FIGS. 2A and 2B show a variation of the body worn transmitter 10A. In this version, the transmitter 40 has its antenna formed by a doubled element 42 embedded in the permanently attached segment of the band 44.

This doubled antenna 42 in the band 44 provides for a greater range for the transmitter 40, allowing the microprocessor 46 to allow for selective adjustments in the range of movement of the wearer allowed without generating an alarm signal. There are oftentimes differences in the living situation of a tethered person, i.e., a rural location may require a range of movement considerably greater than a city apartment dweller, and the range adjustment afforded by the microprocessor programming will accommodate such differing situations.

The band 44 is also designed with premarked segments 46 which may be cut as required to fit the band 44 to the limb of the wearer. A relatively snug fit must be ensured to preclude any removal of the band by the wearer and yet not to produce a too tight fit.

According to one aspect of the invention, the band 44 does not need to be in contact with the wearer's skin in order to establish the required circuit connections as has been the case with many prior art devices.

Instead of the change in resistance detector as in the first described embodiment, a clock circuit 50 may be activated by a specially coded start up signal which may be applied by a key 52 or by a special transmission from a transmitter 54 of the base unit 24A received by a receiver unit 56 included the body worn transmitter 10A which in turn applies the start up signal to the clock circuit 50 initiating operation of the transmitter 40.

Once initiated, the clock circuit 50 will continue unless there is an interruption in the circuit loop defined by the band 44. Any interruption will cause cessation of the transmissions until the coded start up signal is again applied as with the key 52 received via the receiver 56. In order to allow for repeated trimming during fitting, a ten minute delay can be provided after start up, allowing removal of the band 44 without the need to restart the clock circuit 50.

According to another aspect of this embodiment, an optional out of range feature may be provided when the receiver 58 of the base unit 24A detects an out of range transmission from the transmitter 40, i.e., a signal of sufficient weakness as to indicate an out of range location of the body worn transmitter 10A. The central microprocessor 60 will cause an add-on transmitter 54 to transmit a special signal to the receiver 56 to cause a vibrator 62 to be energized. The transmitter 54 is preferably received by a separately provided pager alarm 64 carried by the person wearing the remote transmitter 10A which provides an audible alarm to the person, notifying him or her of his or her out of range position and giving a predetermined time interval to reenter the proper zone of confinement.

A suitable period is selected, as, for example, one half the time period between the periodic transmissions by the transmitter 40, i.e., if 2 minute interval transmissions are programmed, then a 1 minute interval may be provided to allow time for the person to reenter the proper confinement zone.

In the meantime, no alarm signal or violation report is transmitted to the modem 70 by the central processor 60 pending receipt of a within range transmission from the transmitter 40. This arrangement provides a simple means for avoiding inadvertent straying of the wearer, greatly reducing the burdens on both the monitoring personnel, as well as the confined person.

Figure 3:
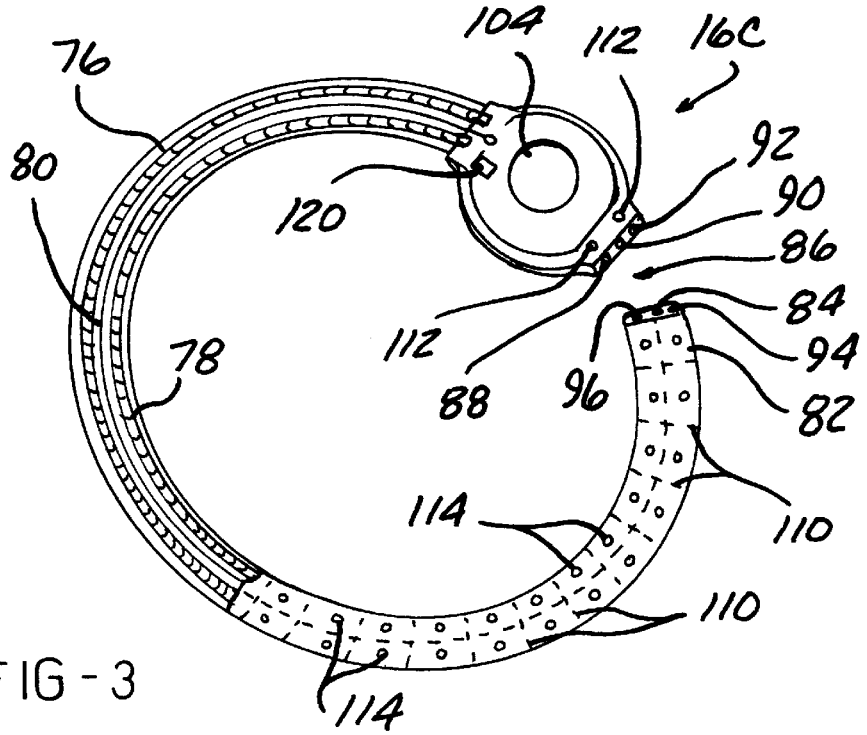
FIG. 3 is a reverse view of the body worn transmitter according to the present invention.
Figure 3A:
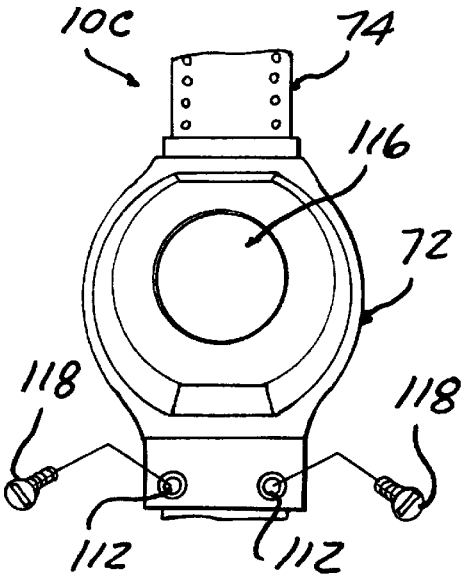
FIG. 3A is a front view of the body worn transmitter according to the present invention.

FIG. 3 shows an actual embodiment of one form of the body worn transmitter 10C which includes a casing 72 and a flexible band 74. One end of the flexible band 74 is permanently attached to the casing 72 as indicated, with a doubled antennae 76 embedded in the flexible rubber or plastic material of the band 74, having a double back segment 78 to increase the antenna length, i.e., to 230 millimeters for example.

In addition, a flexible conductor 80 is embedded in the band 74, electrically connected to the internal circuitry, extending around to the free end 82 of the band 74. The conductor 80 is connected to socket terminal 82 molded into each segment of the band end 82. The casing 72 is provided with a band receiving socket 86 having three outwardly projecting pins 88, 90, 92. The center pin 90 is received in the terminal 84 to electrically connect the conductor 80 to the internal circuitry.

Figure 5:
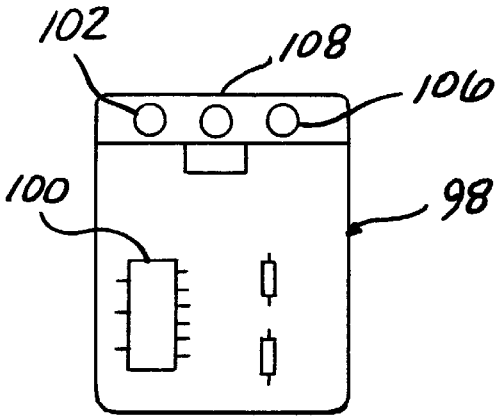
FIG. 5 is a perspective view of an activation key which may be used to activate the transmitter according to the present invention.

The other two pins 88, 92 are received in dummy holes 94 and 96 in the end of the band 82. The pins 88, 92 allow use of the key 98 shown in FIG. 5, for application of a start up coded signal as described above.

The start up signal may be produced from an integrated circuit chip 100 embedded in the key 98 with one socket 102 allowing powering of the key via a three volt dc output on the pin 88.

A battery may be installed into the rear face of the casing 72, 104. A socket 106 allows the input of the start up code as well as a resistive code on socket 108 setting the initial resistance value of the flexible band conductor 80.

The free end of the flexible band 74 is marked with segment lines 110 for cutting off length adjustments when fitting the band to the person to be monitored. A pair of transverse holes 112 are provided in the casing receiving locking pins which pass through pairs of holes 114 in each segment located so as to come into alignment when the free end of the flexible band 74 is inserted in the socket 86 of the casing 72. The cutting lines 110 maintain the proper alignment for each segment.

Figure 8A:
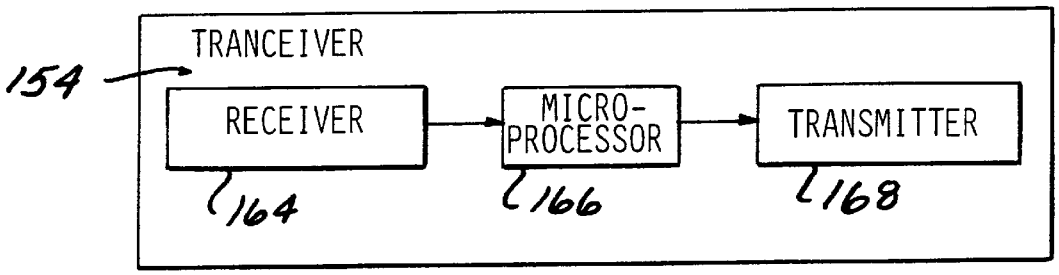
FIGS. 8A and 8B are block diagrams of components of another embodiment of the present invention.
Figure 8B:
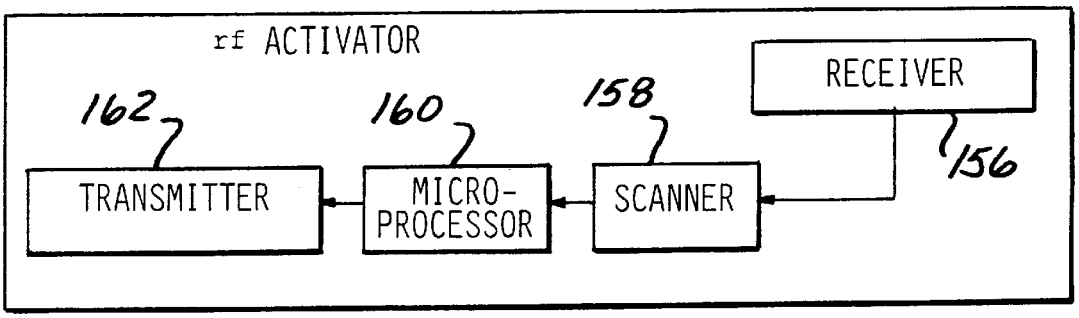

FIG. 8 shows the front side of the housing 72 in which a test button 116 can be seen which can be pressed to cause a transmission signal to be sent prior to start up of the unit. This allows the base unit to learn the coded identifier signal of the particular body worn transmitter 10C.

The pins 118 are also shown in this view which are passed into the holes 112. The conductor 80 can be electrically connected to the internal circuitry by means one of the pins 118 in order that removal of both pins will break the electrical connection in addition to that interruption caused by cutting of the flexible band 74 itself.

A vibrator 120 may be provided on the rear face of the casing 72 if the out of range feature is built into the body worn transmitter 10C, placed into contact with the skin of the wearer.

A test button 116 can also be employed for verifying that the range setting is adequate to allow free movement of the wearer about the premises. That is, the button 116 can be pressed at the most remote location, and the base unit will sound a beep when receiving the test signal.

The absence of a transmission signal from the body worn transmitter 10 will result in a report being transmitted to the remote monitoring station. After a maximum break period, the length of which can be programmed, i.e., from 3 minutes to 16 minutes in 1 minute increments, with a default value of 10 minutes. Thus, an immediate failure of the signal of the transmission signal will not result in an alarm condition being reported to the monitoring station which does not occur until the predetermined maximum break period has been reached.

The software will also report to the remote monitoring station when and if the signal is reestablished, even if occurring after the maximum break. The base unit is also preferably programmed to report any ac power failure, and the restoration of ac power to the monitoring station, in addition to the low battery of the base unit or body worn transmitter.

Figure 4:
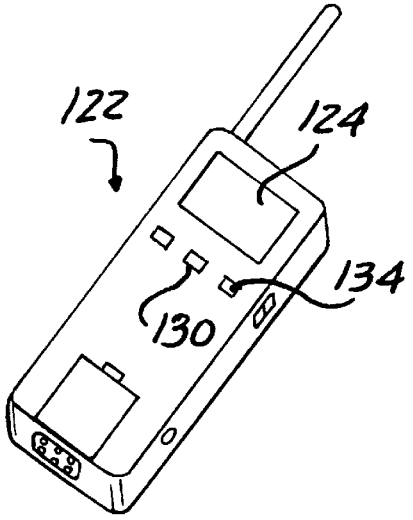
FIG. 4 is a perspective view of a portable base unit according to the present invention.

FIG. 4 shows a hand held or portable base unit 122 which can be programmed with a stored signal corresponding to a number of signal codes corresponding to several body worn transmitters with a screen display 124 enabling display of a identification of a particular signal such that a user can monitor the presence several body worn transmitters as for use by a drive by checks by a probation officer.

The hand held monitor base unit 122 can advantageously provide a button 130 for reading the strength of the signal received on the screen 124 and command button 132 and read button 134.

The same device can also allow the monitoring of off limit locations such as bars, etc., by the officer who can remotely detect the presence of a person wearing the body worn transmitter at such locations.

Figure 6:
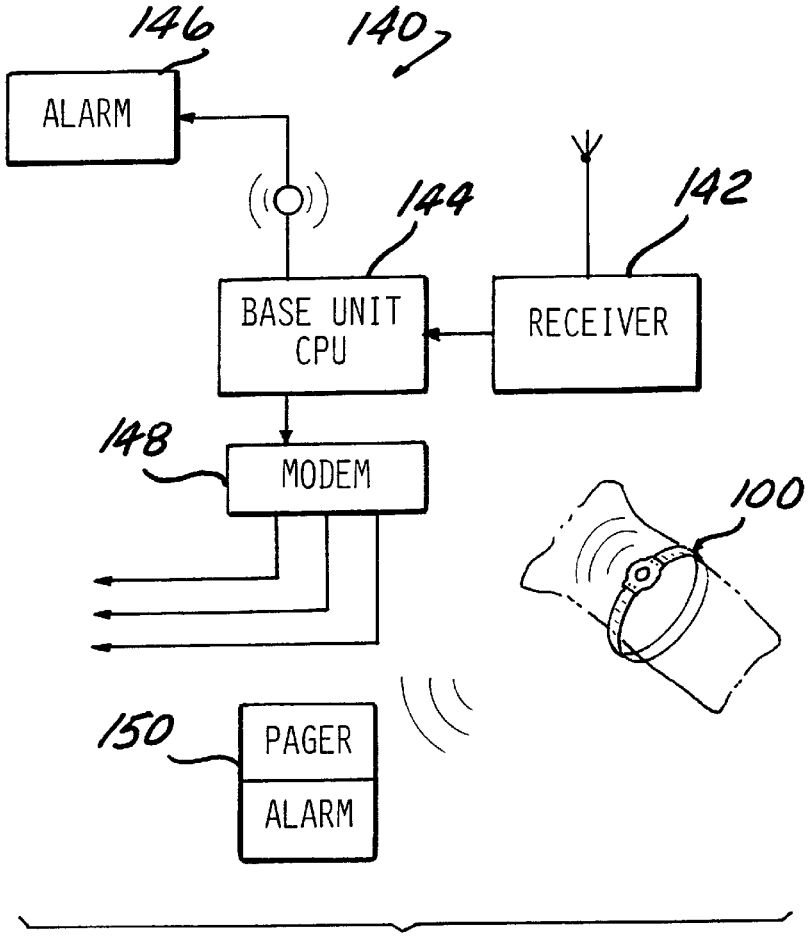
FIG. 6 is a block diagram representation of a body worn transmitter and monitoring base unit alarm system.

FIG. 6 shows an application to personal protection in which the body worn transmitter unit 10D is used with a local base unit 140 which includes a receiver 142 receiving a transmission therefrom having an identification code stored in the memory of the microprocessor 144 corresponding to the presence within a predetermined range of the person wearing a particularly identified body worn transmitter 10D. Upon receipt of such signal, a local alarm such as a sound or light display 146 is triggered and one or more messages sent to remote monitoring locations via a modem 148, i.e., dialing the local police, emergency personnel, etc. At the same time, a pager alarm 150 when carried by the person can also be triggered by the transmission from the body worn transmitter 10D.

This is to provide an alarm signal to the person carrying the same of the presence of the person when not near the base unit.

Figure 7:
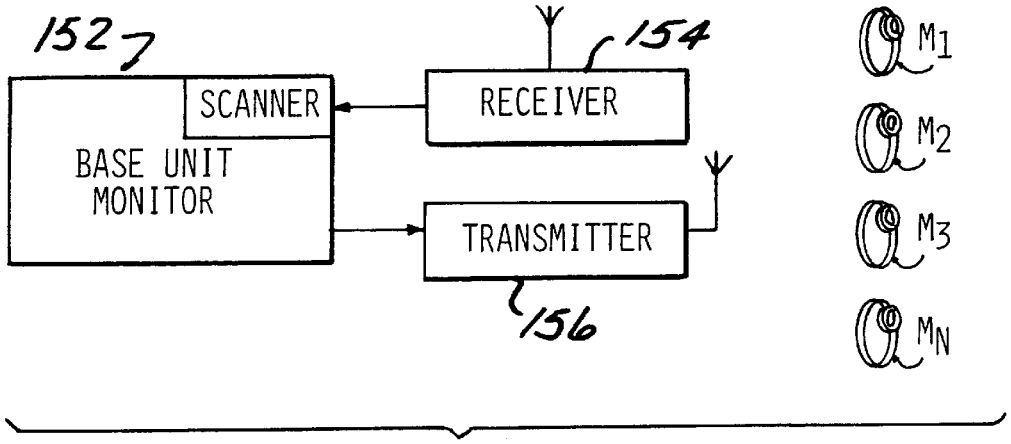
FIG. 7 is a block diagram representation of a multi unit base unit monitoring device.

FIG. 7 shows another application useful for monitoring the presence of a large number of individuals in a particular location or even to track the presence of objects at that location. A series of transmitters $M_1$–$M_N$ are monitored by a base unit 152 which includes a receiver 154 and transmitter 156. In this instance, a time slot is assigned to each of the transmitters $M_1$–$M_N$ by the base unit 152.

Figure 9:
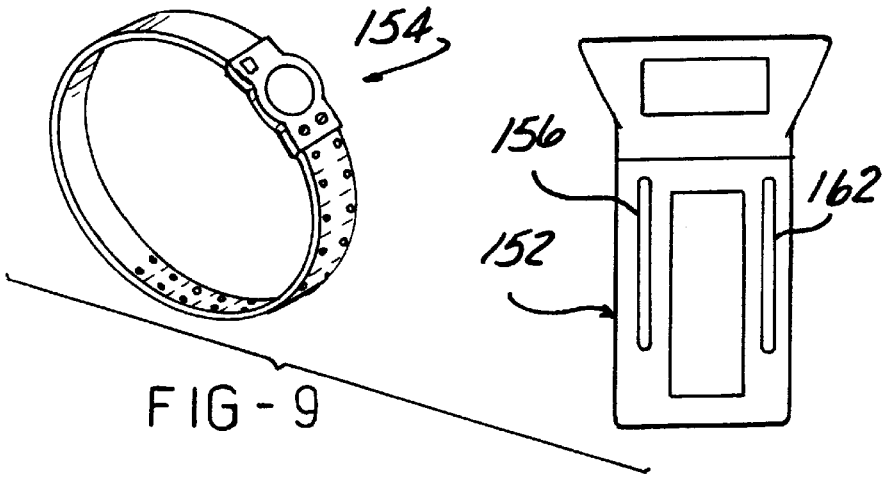
FIG. 9 is a simplified front view of the major components of the embodiment shown in block diagram form in FIG. 8.

The periodic transmissions of each of the transmitters $M_1$–$M_N$ occur at unique time slots within an overall reporting time period which slot is assigned from a scanning of transmissions from a transmitter 156 as indicated in FIG. 7. The base unit 152, as shown in FIG. 9, includes an rf scanner section which logs in the time of receipt of a particular coded rf transmission over a scheduling interval, noting any open time periods as indicated.

For each new body worn transmitter 154, the base unit 152 assigns an open or unused air time slot such that each body worn transmitter 154 transmits at its own unique scheduled time slot such as to ensure that the base unit 152 can monitor a large number of transmitters by segregating the time scheduled for transmission from each.

This is indicated in the block diagram on the right side of FIG. 8, in which the information from a receiver section 156 is analyzed in a scanner section 158 and the information concerning used and unused time slots is transmitted to the microprocessor 160 which then transmits a signal to the particular body worn receiver 154 to initiate at the appropriate time the beginning of the cyclical transmissions by that activated transmitter 154.

The body worn transmitter 154 also has a receiver section 164 and microprocessor 166 which responds to an activation signal to activate its transmitters 168 at the allotted time slot. The body worn transmitter 154 can also be employed as an inventory control, such that it is not body worn but merely mounted to an item of equipment or product for purposes of inventory control or for other purposes to monitor the presence at a particular location of the item being monitored.

Figure 10:
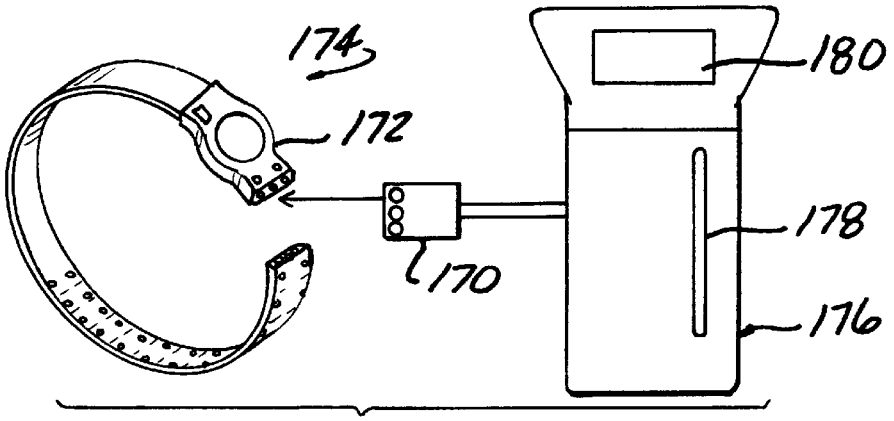
FIG. 10 is a top view of another variation of the present invention.
Figure 11:
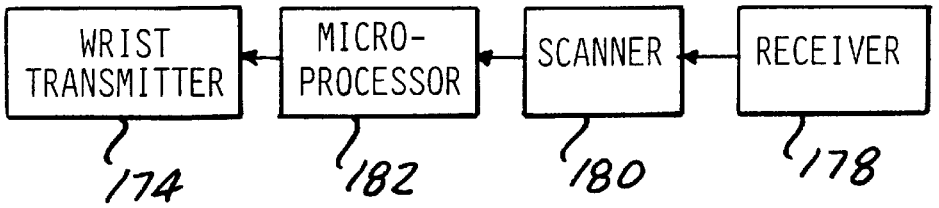
FIG. 11 is a block diagram representation of the embodiment shown in FIG. 10.

FIGS. 10 and 11 show a manually implemented system in which a plug 170 is inserted into the casing 172 of a transmitter 174, in order to initiate a transmission cycle at an assigned time period. The base unit 176 which is equipped with a receiver and scanner as in the embodiment in FIGS. 8 and 9 rather than relying on transmitter receiver couplings between the base unit 176 and the body worn transmitter 174.

As before, the base unit 176 has a receiver 178 to monitor the transmissions by a large number of body worn transmitters which are analyzed in a scanner 180 and the used and unused time slots recorded in the memory of the microprocessor 182 which via the direct plug coupling 170 assigns a time slot to the body worn transmitter 174. The arrangement shown in FIGS. 8–11 can be very useful for monitoring the presence of large numbers of individuals such as in penal institutions, military installations, research facilities, and the like as a relatively great number of individuals can be monitored with a single base unit by the technique described. In addition, the technique can also be applied to inventory or equipment monitoring applications to keep track of movement of equipment, products, inventory, vehicles, etc., limited only in the time period for which a complete round of transmissions is required.

Figure 12:
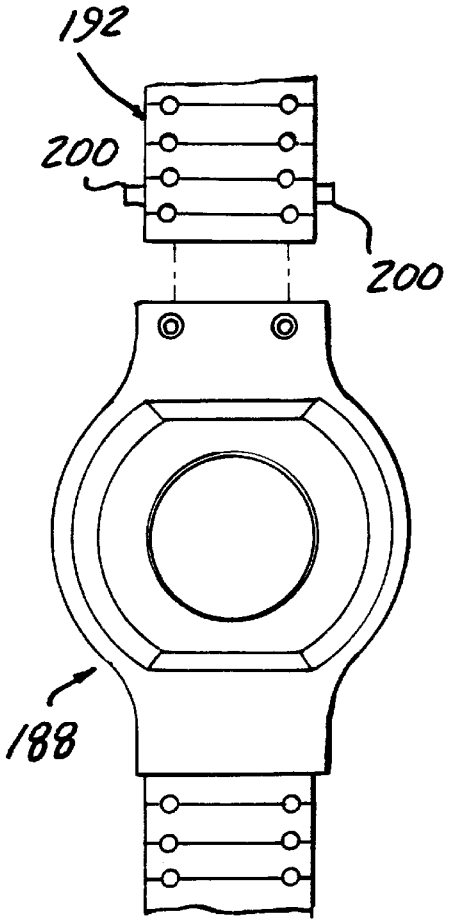
FIG. 12 is a fragmentary view of an alternate form of the body worn transmitter.
Figure 13:
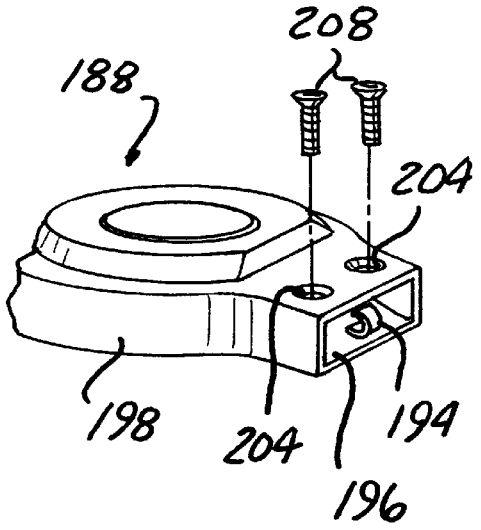
FIG. 13 is a fragmentary perspective view of a transmitter casing with exploded tamper resistant screws.
Figure 14:
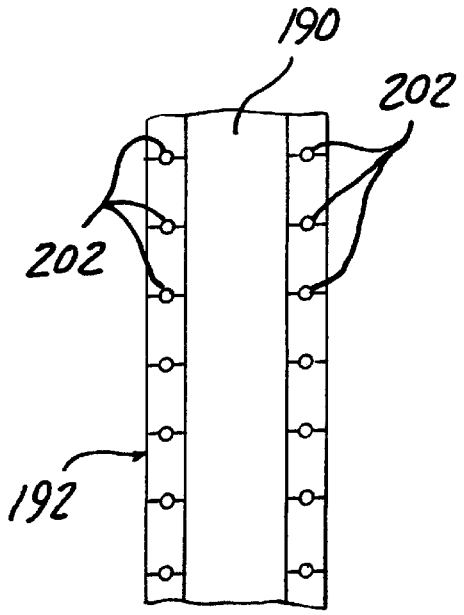
FIG. 14 is a reverse fragmentary view of a wrist band.

A simplified preferred form of the body mounted transmitter 188 is shown in FIGS. 12–14, which uses a recessed conductive strip 190 on the underside of the band 192 mateable with a contact clip 194 within the socket 196 in one end of the casing 198 when the band 192 is partially inserted therein.

The body mounted transmitter 188 has a clock circuit as shown in FIG. 2B which is activated whenever contact is made between the strip 190 and clip 194 to initiate the clock circuit and rf coded signal transmissions.

The end of the band 192 is formed with molded guide tabs 200 to insure sufficient insertion to start the clock circuit.

The tabs 200 are removed when the band 192 is cut to size, allowing full insertion to line up holes 202 in the band 192 with holes 204 in the case 198.

Tamper resistant screws 208 secure the band 192 in position.

Once started, the program allows the clock circuit to be turned on and off by repeated insertion and removal of the band 192 for a ten minute period. After expiration of the ten minute period, if the circuit of the band strip 190 is interrupted as by cutting of the band or removal thereof, the program turns the clock off permanently, preventing any restarting.

What is claimed is:

1. A body worn personal monitor comprising:

a case containing an rf transmitter;

a battery for powering said transmitter and a control for periodically causing a coded signal to be transmitted by said transmitter;

an elongated flexible band connected at either end to said case to enable encircling of a body member to allow wearing of said case by a person to be monitored;

an electrically conductive element extending within said band and electrically connected at each end thereof to an electronic detector in said case;

a connector for detachably connecting one end of said band to said casing including an electrical terminal for establishing an electrical connection between said conductive element and said detector in said casing;

said detector sensing and storing said resistance value of a circuit including said conductive element when said band is installed, and means causing ceasing transmission of said coded signal if a different resistance value is sensed, whereby if said band is cut and said circuit completed by another conductor, the difference in resistance will cause a cessation of rf signal transmission.

2. The monitor according to claim 1 wherein said flexible band is marked in segments able to be cut off when being fit to the body member of a person to be monitored.

3. The monitor according to claim 2 wherein each band segment has a pair of mounting holes formed therein at a predetermined lengthwise position on each segment, and wherein said casing has socket portion formed with holes aligning with said holes in each segment when a particular segment is inserted in said socket, a pair of fasteners received in said holes to secure said one end of said band to said casing.

4. The monitor according to claim 3 further including an rf antenna embedded in a portion of said band.

5. The monitor according to claim 4 wherein said antenna is doubled within said band portion.

6. The monitor according to claim 1 further including an activation key insertable in a socket on one side of said casing transmitting a coded signal to said detector upon initial fitting to enable activation of said rf transmitter.

* * * * *